US010415873B2

(12) United States Patent
Hanson

(10) Patent No.: US 10,415,873 B2
(45) Date of Patent: Sep. 17, 2019

(54) DUAL ASYMMETRICAL AND SYMMETRICAL ARCHITECTURE CANTILEVER POSITIONING

(71) Applicant: Electrolux Home Products, Inc., Charlotte, NC (US)

(72) Inventor: Josh Hanson, Charlotte, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 94 days.

(21) Appl. No.: 15/836,007

(22) Filed: Dec. 8, 2017

(65) Prior Publication Data

US 2019/0178567 A1 Jun. 13, 2019

(51) Int. Cl.
*F25D 25/02* (2006.01)
*A47B 96/06* (2006.01)
(Continued)

(52) U.S. Cl.
CPC ..... *F25D 25/02* (2013.01); *A47B 96/027* (2013.01); *A47B 96/061* (2013.01);
(Continued)

(58) Field of Classification Search
CPC .. F25D 25/02; F25D 2325/021; F25D 25/024; F25D 2325/022; F25D 23/066; F25D 2400/18; F25D 17/045; F25D 17/065; F25D 2317/067; F25D 2317/0665; F25D 17/062; F25D 23/068; F25D 2317/0666; F25D 2317/061; A47B 96/027; A47B 96/061; A47B 57/42; A47B 96/1408; A47B 96/06; A47B 47/022; A47B 96/028; A47B 57/52; A47B 57/16; A47B 57/40; A47B 57/30; A47B 96/14; A47B 96/025; A47B 96/1458; A47F 5/103; A47F 5/08; A47F 5/0043
(Continued)

(56) References Cited

U.S. PATENT DOCUMENTS 3,234,897 A * 2/1966 Berk ..... A47B 57/42 108/108
3,601,463 A 8/1971 Watt
(Continued)

FOREIGN PATENT DOCUMENTS

| | | |
|---|---|---|
| FR | 1281572 | 1/1962 |
| JP | 5461864 | 10/2010 |
| KR | 100903976 | 8/2004 |

*Primary Examiner* — Hiwot E Tefera
(74) *Attorney, Agent, or Firm* — Pearne & Gordon LLP

(57) ABSTRACT

A refrigerator appliance including a compartment within the refrigerator appliance, a liner defining a rear wall of the compartment, a first vertical support rail attached to the rear wall, a second vertical support rail attached to the rear wall wherein the second vertical support rail is offset in a generally horizontal direction from the first vertical support rail, and a cover. The cover is attachable to the liner and includes a vertical slot extending therethrough and configured to align with and allow access to one of the first vertical support rail and the second vertical support rail when the cover is attached to the liner, while a portion of the cover is positioned over and prevents access to the other of the first vertical support rail and the second vertical support rail.

17 Claims, 10 Drawing Sheets

(51) Int. Cl.
*A47B 96/02* (2006.01)
*F25D 23/06* (2006.01)
*F25D 17/06* (2006.01)

(52) U.S. Cl.
CPC ..... *F25D 23/067* (2013.01); *F25D 17/065* (2013.01); *F25D 2317/067* (2013.01); *F25D 2325/021* (2013.01); *F25D 2400/18* (2013.01)

(58) Field of Classification Search
USPC ..... 312/408; 108/108
See application file for complete search history.

(56) References Cited

U.S. PATENT DOCUMENTS 3,670,521 A 6/1972 Dodge, III et al.
3,674,359 A 7/1972 Crowe
3,834,177 A 9/1974 Scarlett
3,835,660 A 9/1974 Franck
3,872,688 A 3/1975 Tillman
3,984,223 A 10/1976 Whistler, Jr.
4,120,550 A 10/1978 Sherburn
4,244,637 A 1/1981 Boorman, Jr.
4,304,101 A 12/1981 Gidseg
4,467,618 A 8/1984 Gidseg
4,638,644 A 1/1987 Gidseg
5,720,536 A 2/1998 Jenkins et al.
6,019,447 A 2/2000 Jackovin
6,112,542 A * 9/2000 Lee ..... F25D 17/065 62/407
6,415,623 B1 7/2002 Jennings et al.
6,644,609 B1 * 11/2003 Scott ..... A47B 57/42 248/243
6,926,379 B1 8/2005 Grace et al.
7,107,785 B2 9/2006 Barmann et al.
7,299,651 B2 * 11/2007 Oh ..... F25D 17/062 62/407
7,410,229 B2 8/2008 Pohl et al.
7,410,230 B2 8/2008 Anderson et al.
7,490,916 B2 2/2009 Anderson et al.
7,726,756 B2 6/2010 Fu
RE42,687 E 9/2011 Yoon
8,398,186 B2 3/2013 Higami
8,511,766 B2 8/2013 Sonnenfroh et al.
8,845,047 B2 9/2014 Luisi et al.
9,097,454 B2 8/2015 LeClear et al.
9,115,924 B2 8/2015 Leclear et al.
9,429,357 B2 8/2016 Cha et al.
9,441,873 B1 9/2016 Drach et al.
10,041,717 B2 * 8/2018 Maxwell ..... F25D 17/045
2004/0173549 A1 * 9/2004 Herron, III ..... A47B 57/42 211/90.02
2007/0089819 A1 * 4/2007 Zenkich ..... A47F 5/0043 150/158
2009/0290992 A1 11/2009 Long
2010/0031694 A1 * 2/2010 Benz ..... A47B 96/027 62/465
2010/0295435 A1 * 11/2010 Kendall ..... F25D 17/062 312/401
2013/0277323 A1 * 10/2013 Cheong ..... F25D 23/00 211/119.003
2016/0102905 A1 4/2016 Cha et al.
2016/0252294 A1 9/2016 Cha et al.
2016/0265837 A1 9/2016 Bhatt et al.
2016/0278519 A1 * 9/2016 Seeley ..... F25D 25/024
2016/0298895 A1 10/2016 Drach et al.
2018/0172339 A1 * 6/2018 Lindel ..... F25D 11/00
2018/0352953 A1 * 12/2018 Nilsson ..... A47B 57/16

* cited by examiner

DUAL ASYMMETRICAL AND SYMMETRICAL ARCHITECTURE CANTILEVER POSITIONING

FIELD OF THE INVENTION

This application relates generally to a shelf assembly for a refrigeration appliance, and more particularly, to a refrigeration appliance including a shelf assembly configuration having at least two vertically oriented support rails attached to a rear wall of the refrigerator appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Refrigerator appliances are also known to include a plurality of shelves within at least the fresh food compartment for storing various items thereon. Said shelves include support arms that removably engage with a ladder track or support rail attached to the rear wall of the fresh food compartment.

Many modern refrigerators use a pair of French-type doors wherein two opposing doors allow access to the fresh food compartment. Some refrigerators are designed such that said refrigerator doors present a symmetrical configuration (i.e., the two opposing doors have the same width), while others are designed such that said refrigerator doors present an asymmetrical configuration (i.e., the two opposing doors have different widths). In either configuration, a central support rail is aligned with a separation point between the two opposing doors. Thus, during manufacturing, positioning the attachment location of the central support rail to the rear wall of the fresh food compartment depends on whether the refrigerator has a symmetrical or asymmetrical configuration. As such, multiple processing lines or tool change over operations are required to manufacture said refrigerators.

There is a need in the art for a refrigerator having multiple central support rails attached to the rear wall of the fresh-food compartment in order to pre-fabricate said refrigerator to accommodate both symmetrical and asymmetrical configurations.

BRIEF SUMMARY OF THE INVENTION

In accordance with one aspect, there is provided a refrigerator appliance including a compartment within the refrigerator appliance for storing food items in a cooled environment. The compartment includes a liner defining a rear wall of the compartment, a first vertical support rail attached to the rear wall, and a second vertical support rail attached to the rear wall wherein the second vertical support rail is offset in a generally horizontal direction from the first vertical support rail.

The compartment further includes a cover attachable to the liner on the rear wall of the compartment. The cover includes a vertical slot extending therethrough and configured to align with and allow access to one of the first vertical support rail and the second vertical support rail when the cover is attached to the liner, while a portion of the cover is positioned over and prevents access to the other of the first vertical support rail and the second vertical support rail.

The refrigerator appliance further includes a shelf support arm that is selectively mounted to said one of the first vertical support rail and the second vertical support rail that is accessible via the vertical slot. A shelf panel is configured to attach to the shelf support arm to thereby be supported within the compartment.

DESCRIPTION OF EXAMPLE EMBODIMENTS

Figure 1:
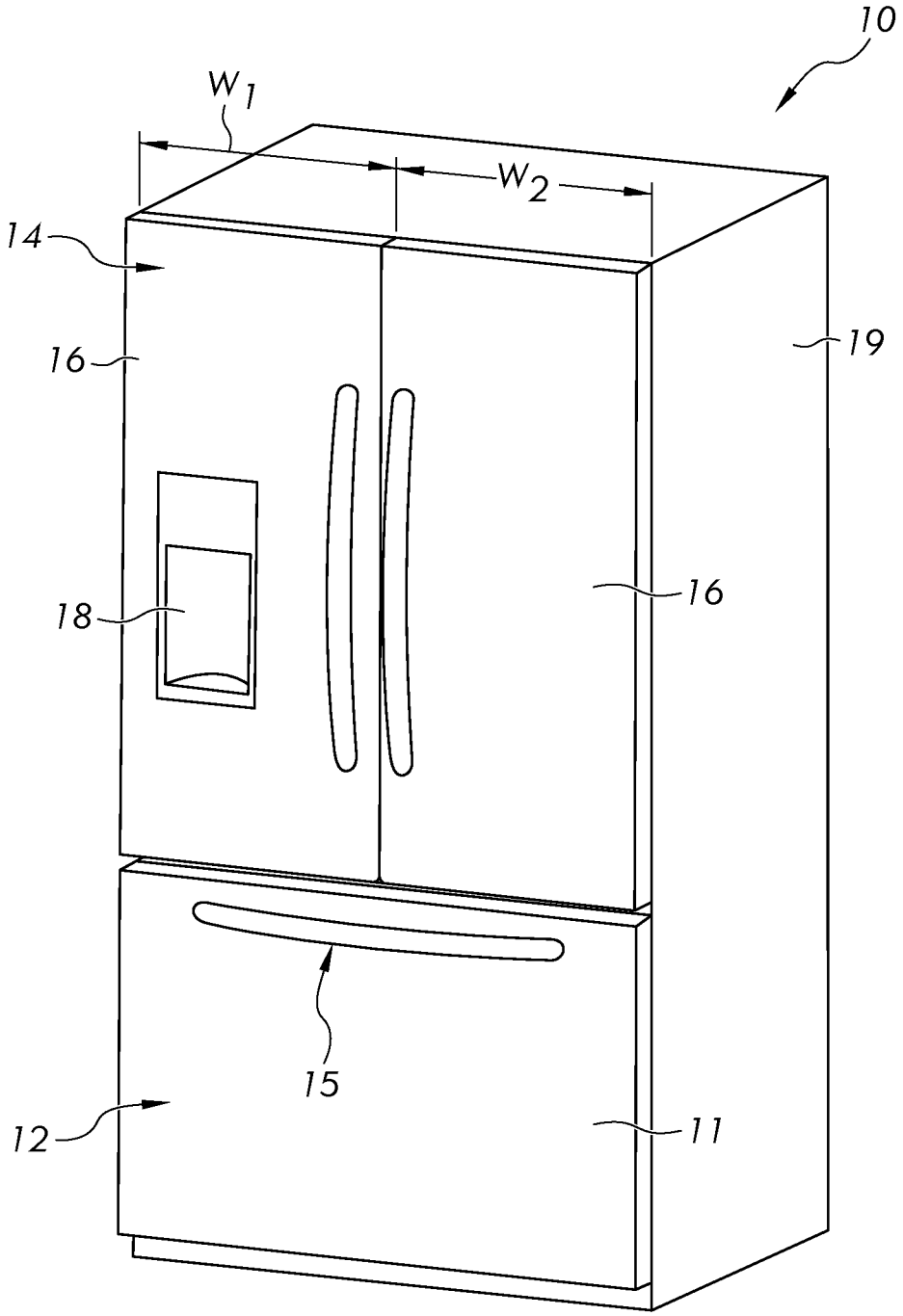
FIG. 1 is a front perspective view of a household French Door Bottom Mount refrigerator showing symmetrical doors of the refrigerator in a closed position.

An example apparatus will now be described more fully hereinafter with reference to the accompanying drawings in which embodiments of the disclosure are shown. Whenever possible, the same reference numerals are used throughout the drawings to refer to the same or like parts.

Referring now to the drawings, FIG. 1 shows a refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a standalone refrigerator or freezer, etc. wherein opposing doors 16 are used to close a compartment.

In FIG. 1, the freezer compartment 12 is arranged vertically beneath the fresh food compartment 14. The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

Figure 2:
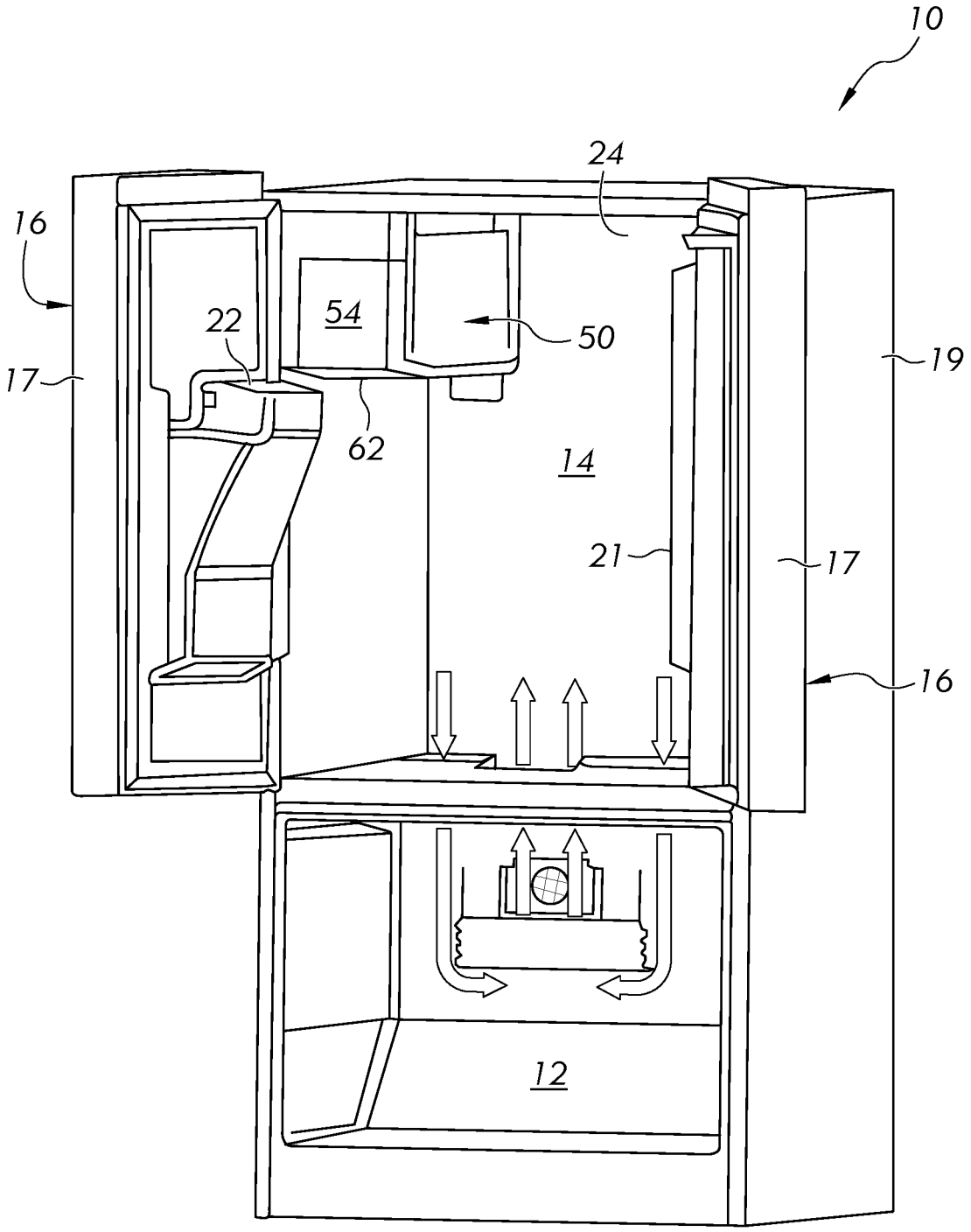
FIG. 2 is a front perspective view of the refrigerator of FIG. 1 showing the symmetrical doors in an opened position and an interior of a fresh food compartment.

Referring to FIG. 2, the refrigerator 10 includes an interior liner 24 that defines the fresh food compartment 14. The fresh food compartment 14 is located in the upper portion of the refrigerator 10 in this example and serves to minimize spoiling of articles of food stored therein. The fresh food compartment 14 accomplishes this by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C. According to some embodiments, cool air from which thermal energy has been removed by the freezer evaporator for the freezer compartment 12 can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 14 independent of the freezer compartment 12. According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 54 (FIG. 2) of an ice maker 50 disposed within the fresh food compartment 14. Ice pieces from the ice bin 54 can exit the ice bin 54 through an aperture 62 and be delivered to the dispenser 18 via an ice chute 22 (FIG. 2), which extends at least partially through the door 16 between the dispenser 18 and the ice bin 54.

In alternative embodiments, the ice maker is located within the freezer compartment. In this configuration, although still disposed within the freezer compartment 12, at least the ice maker (and possible an ice bin) is mounted to an interior surface of the freezer door. It is contemplated that the ice mold and ice bin can be separate elements, in which one remains within the freezer compartment 12 and the other is on the freezer door.

Referring to FIG. 1, the doors 16 for closing the fresh food compartment 14 are pivotally coupled to a cabinet 19 of the refrigerator 10 to restrict and grant access to the fresh food compartment 14. The doors 16 are a pair of French-type doors 16 that collectively span the entire lateral distance of the entrance to the fresh food compartment 14 to enclose the fresh food compartment 14. Referring to FIG. 2, a center flip mullion 21 is pivotally coupled to at least one of the doors 16 to establish a surface against which a seal provided on the other one of the doors 16 can seal the entrance to the fresh food compartment 14 at a location between opposing side surfaces 17 of the doors 16. The mullion 21 can be pivotally coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation, such as substantially perpendicular or other angle. The seal and the externally-exposed surface of the mullion 21 cooperate approximately midway between the lateral sides of the fresh food compartment 14.

Referring to FIG. 1, the refrigerator 10 is a "symmetrical" refrigerator. "Symmetrical" meaning that the two refrigerator doors 16 are the same width. In other words, the widths $W_1$ and $W_2$ for the doors 16 are equal.

Figure 3:
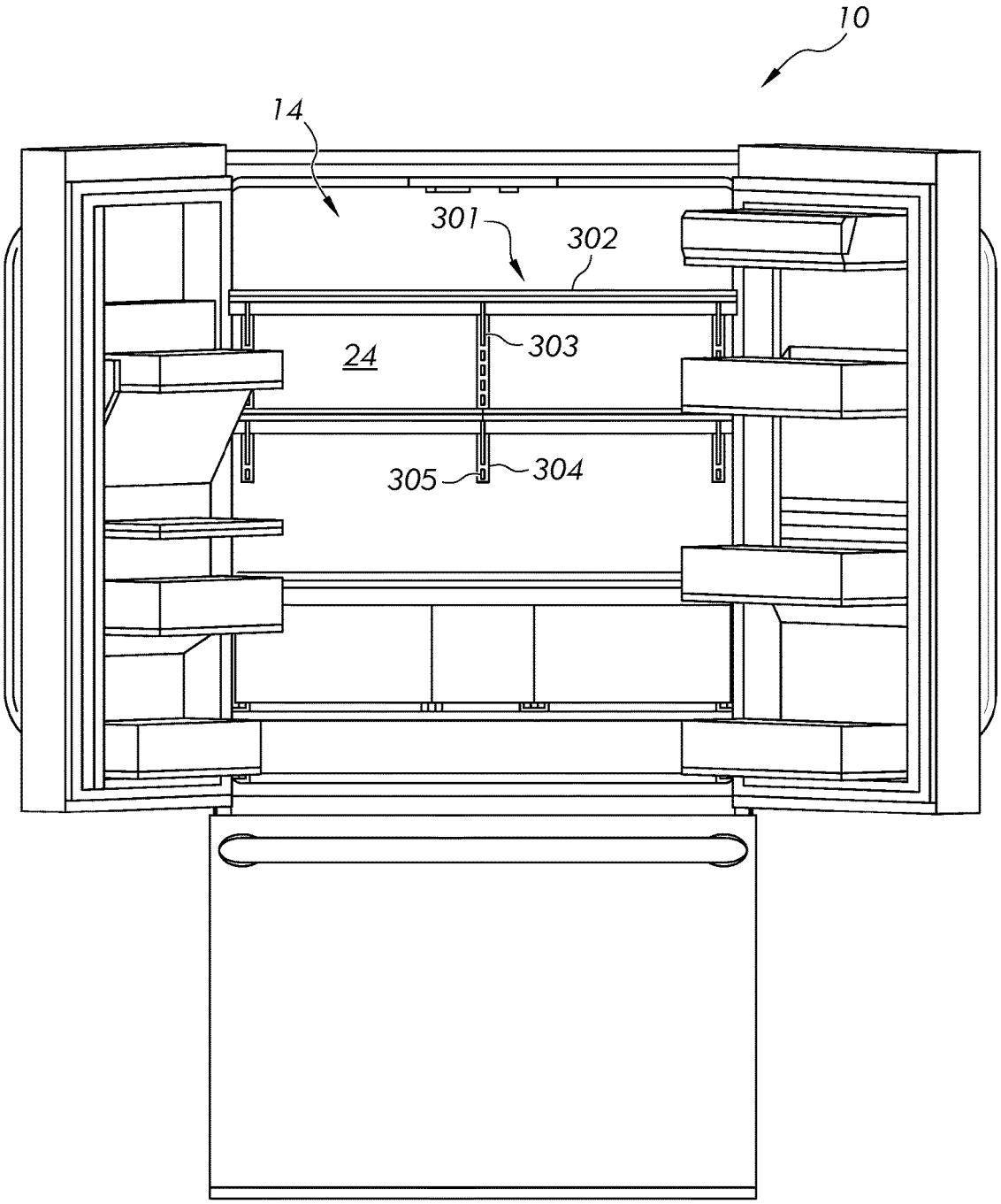
FIG. 3 (PRIOR ART)
FIG. 3 is a front view of a prior art refrigerator including a shelf assembly.

Turning to the shown example of FIG. 3, a conventional shelf assembly 301 known in the art is described that can be removed from the fresh food compartment 14 of the refrigerator 10 while leaving a support frame in place. The removable portion of the shelf assembly 301 includes a shelf panel 302 comprised of materials that are dishwasher safe. Also, since the shelf panel 302 is not permanently attached to the support frame, the shelf panel 302 can be taken out of the refrigerator 10 for use as a serving platter, for cleaning, or other uses.

Generally the shelf panel 302 is supported by a frame and includes a planar support surface. Alternatively, the shelf panel 302 may include no frame such that at least one edge of the planar support surface is exposed.

The shelf assembly 301 further includes at least one shelf support arm 303 configured to be attached with respect to the interior liner 24 of the fresh food compartment 14 to support the shelf panel 302 therein. As shown, a pair of shelf support arms 303 can be used, with one support arm located at and supporting each lateral end of the shelf panel 302. In one example, one or more of the shelf support arms 303 can include an interlocking device configured to be removably attached with respect to the interior liner 24 at a selected elevation with the shelf support arms 303 acting as a cantilever support for the shelf panel 302. In the illustrated embodiment, a plurality of ladder tracks or vertical support rails 304 are provided with an array of vertically disposed apertures 305 to allow interaction with the interlocking device to maintain the shelf assembly 301 at the desired user-selected elevation within the fresh food compartment 14 of the refrigerator 10. Preferably, the shelf support arms 303*a*, 303*b* have corresponding attachment structure to be received and retained within the apertures 305, such as hook-shaped members or the like.

Moreover, it is contemplated that the shelf panel 302 can have various shapes and dimensions with the planar support surface configured to support various objects for storage. For example, the shelf panel 302 can be formed of various generally rigid materials, such as glass, plastic, metal, wire, or other suitable materials. Preferably, the shelf panel 302 comprises a generally translucent or transparent material, such as a tempered or toughened glass or polymer panel suitable for use in a refrigerated environment. The shelf panel 302 may include additional features, such as raised or angled edges extending along the outer perimeter (e.g., front, rear, and/or side edges) to provide a "spill proof" panel and/or one or more support legs to support the shelf panel 302 inside and/or outside of the appliance. Additionally or alternatively, a handle (not shown) can be removably or non-removably fixed along at least a portion of the front edge to facilitate user manipulation of the shelf panel 302. Although for simplicity the remainder of this application will describe a shelf panel as being the supported element within the refrigerated compartment, it is contemplated that other elements can be similarly supported. For example, this application is also suitable for use with a hanging bin or drawer assembly, such as a crisper bin, meat drawer, beverage rack, etc. that may or may not include a traditional "shelf".

Figure 4A:
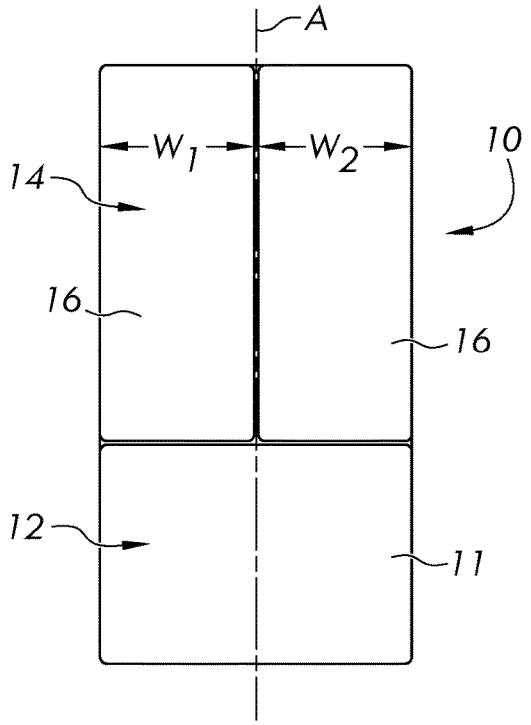
FIG. 4A is a front view of a bottom-mount refrigerator having symmetrical doors.
Figure 4B:
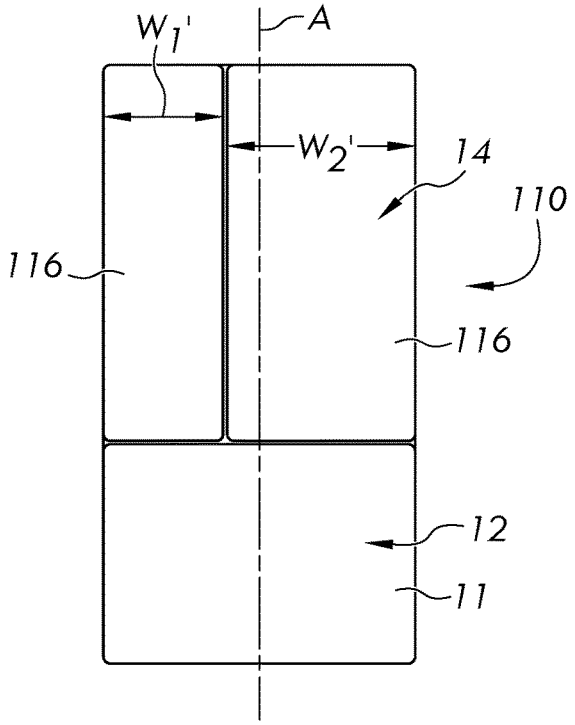
FIG. 4B is a front view of a bottom-mount refrigerator having asymmetrical doors.

FIGS. 4A and 4B illustrate a symmetrical refrigerator 10 and an asymmetrical refrigerator 110, respectively. The symmetrical refrigerator 10 and the asymmetrical refrigerator 110 both include a single freezer drawer 11. The freezer door 11 is connected to a drawer assembly (not shown) including one or more freezer baskets (not shown) that can be withdrawn from the freezer compartment 12 (although it is contemplated that alternatively the freezer could have two or more doors). The plane "A" bisects the refrigerator along its central axis and is shown to comparatively illustrate the width $W_1$ and $W_2$ of the symmetrical doors 16 and the width $W_1'$ and $W_2'$ of the asymmetrical doors 116 relative to the plane "A." As shown, the widths $W_1$ and $W_2$ of the symmetrical doors 16, respectively, are equal, and the widths $W_1'$ and $W_2'$ of the asymmetrical doors 116, respectively, are different. Specifically, the width $W_2'$ of the right most door 116 is larger than the width $W_1'$ of the left most door 116, although the relative widths of the doors could be reversed.

Figure 5:
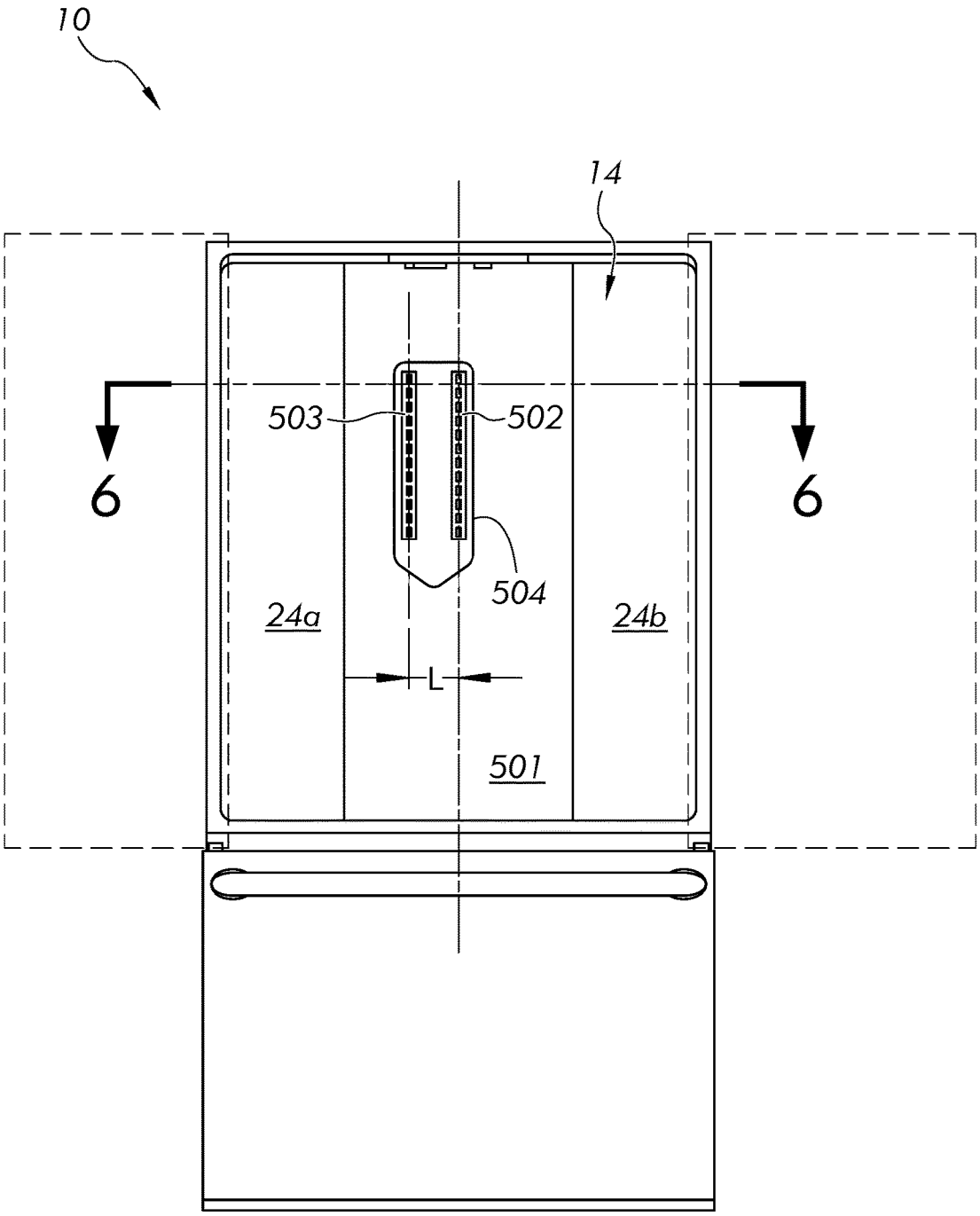
FIG. 5 is a front view of a refrigerator according to a first embodiment showing a rear wall of a fresh food compartment.

Referring now to FIG. 5, a refrigerator 10 according to a first embodiment is shown. The doors (represented by dotted lines) may be of a symmetrical design (i.e., the two opposing refrigerator doors have the same width) or, alternatively, an asymmetrical design (i.e., the two opposing refrigerator doors have different widths).

The interior liner 24 defines a rear wall of the fresh food compartment 14. As shown, the interior liner 24 includes an air tower 501 that extends outwards therefrom. The air tower 501 may be formed integral with the interior liner 24. Alternatively, the air tower 501 may be removably attached to the interior liner 24. Further, the air tower 501 may be located on the rear wall such that the interior liner 24 is divided into multiple sections (preferably, the liner 24 is a single continuous element, although optionally it could be formed of multiple elements). For example, the air tower 501 may be located on the rear wall such that it is interposed between a first interior liner section 24*a* and a second interior liner section 24*b*. The configuration of the air tower 501 may be such that the first interior liner section 24*a* has a horizontal width that is greater than, less than, or equal to a horizontal width of the second interior liner section 24*b*.

An aperture 504 is formed into the air tower 501 and extends completely therethrough. The aperture 504 is positioned with respect to the air tower 501 such that a lateral center line of the aperture 504 is offset in a generally horizontal direction from a lateral center line of the air tower 501. Alternatively, the lateral center line of the aperture 504 may be aligned with the lateral center line of the air tower 501.

A first vertical support rail 502 for supporting one or more shelves (or other items) is attached to the rear wall. Specifically, a lateral center line of the first vertical support rail 502 is aligned with the lateral center line of the rear wall such that the lateral center line of the first vertical support rail 502 aligns with a plane bisecting the fresh food compartment 14 into two equal halves in the horizontal direction (i.e., plane "A" of FIGS. 4A-4B). Additionally, a second vertical support rail 503 is attached to the rear wall. As shown, a lateral center line of the second vertical support rail 503 is offset a distance L in a generally horizontal direction from the lateral center line of the first vertical support rail 502. Although illustrated as offset towards the left in FIG. 5, it is contemplated that it could be likewise offset towards the right with the aperture 504 suitably shifted or enlarged towards the right. As illustrated, the first vertical support rail 502 and the second vertical support rail 503 are positioned within and extend at least partially through the aperture 504 formed into the air tower 501.

The aperture 504 includes a top portion, a bottom portion, and first and second opposing side portions that traverse a generally vertical direction with respect to the rear wall. The bottom portion includes a pointed tip such that the aperture 504 is in the shape of a pentagon, although this design feature is optional. Alternatively, the aperture 504 can be shaped differently. The pointed tip design can be utilized where the pointed tip is included at its vertically lowest position (e.g., triangle, parallelogram, hexagon, etc.).

The air tower 501 guides a flow of air upwards from an evaporator (not shown) positioned within or vertically below the air tower 501. The air tower 501 includes a plurality of air exhaust openings (not shown) spaced along its length to distribute cooled air flow to various portions of the refrigerated compartment. The exhaust openings could be disposed on the front face of the air tower, and/or along one or more side, top, or bottom edges. In one example, the pointed tip of the bottom portion of the aperture 504, optionally together with correspondingly shaped ducting (and/or insulating foam), acts as a separation member that divides the flow of air into first and second flow paths that are disposed adjacent the first and second opposing side portions, respectively. Use of the pointed tip design to gradually separate the air flow into the first and second flow paths can decrease internal flow resistance within the air tower and reduce a pressure drop.

Figure 6:
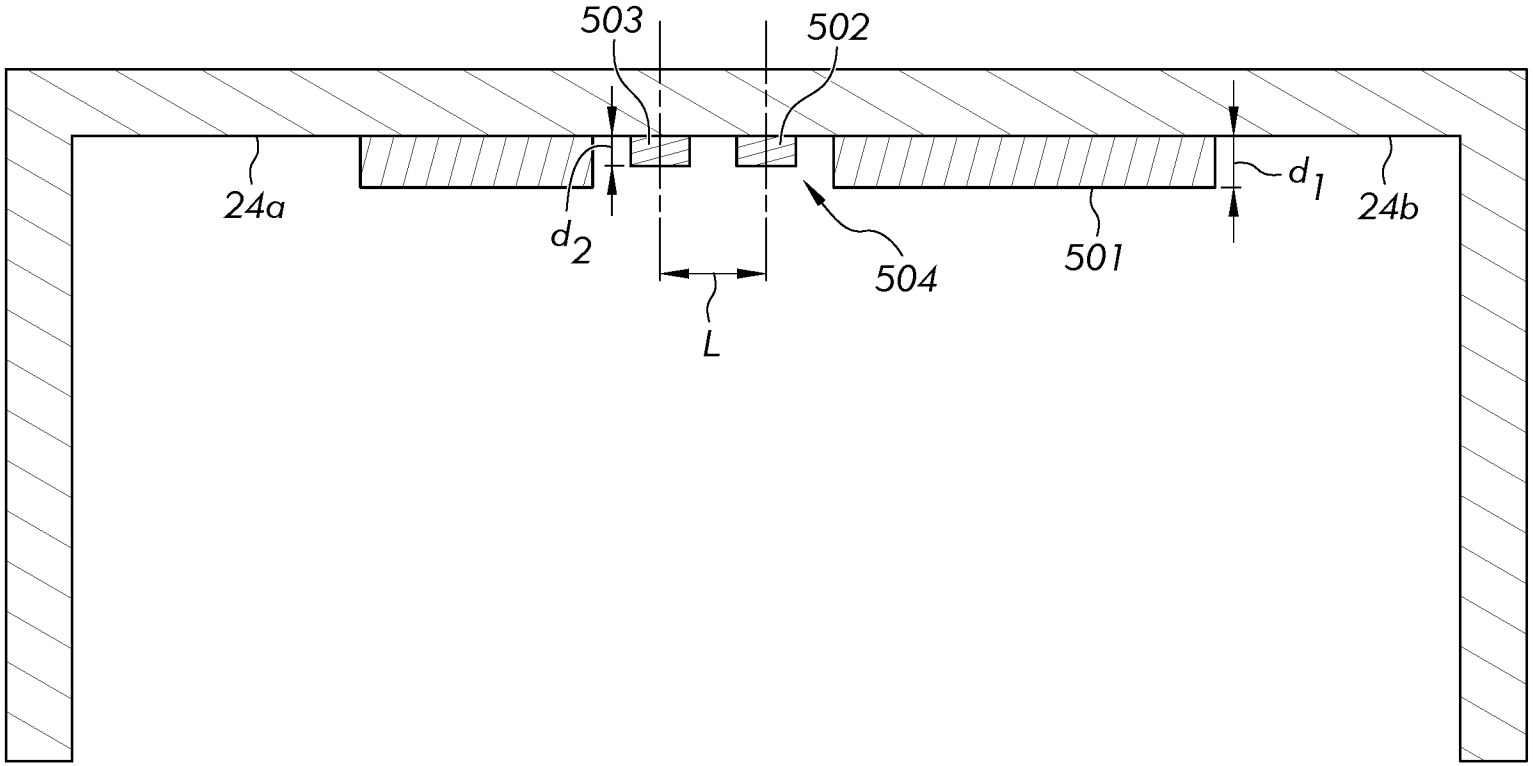
FIG. 6 is a cross-sectional view of the refrigerator of FIG. 5 taken along line 6-6.

FIG. 6 depicts a cross-sectional view of the refrigerator of FIG. 5 taken along line 6-6. For simplicity of discussion, the air tower 501 is schematically shown as a solid piece. However this is not restrictive; rather, various portions of the air tower 501, such as each separate section of the air tower 501 (i.e., separated by the aperture 504), may be hollow. For example, the left and right most sections of the air tower 501 may be hollow to include air plenums which correspond to the aforementioned first and second flow paths, respectively. Moreover, the interior of the air tower 501 may contain insulating foam that defines the air plenums and first and second flow paths. Since the refrigerated air entering the air tower 501 is often relatively colder than the temperature of the fresh food compartment 14, the use of insulating foam within the air tower 501 helps to avoid condensation and/or uneven cold areas within the fresh food compartment 14. However, the use of insulation is not required. Where the air tower 501 is used in a freezer compartment, such insulation may or may not be used.

As shown, the air tower 501 extends outwards from the rear wall at a first distance $d_1$. As previously mentioned, the aperture 504 extends completely through the air tower 501 such that the first vertical support rail 502 and the second vertical support rail 503 are accessible therethrough even though they are attached to the rear wall.

At least one of the first vertical support rail 502 and the second vertical support rail 503 extends from the rear wall at a second distance d2. For example, as illustrated, the second vertical support rail 503 extends from the rear wall at the second distance $d_2$. Further, the first distance $d_1$ (i.e., the distance at which the air tower 501 extends from the rear wall) is greater than the second distance $d_2$. In alternative embodiments, not shown, the first vertical support rail 502 extends from the rear wall at the second distance, the second vertical support rail 503 extends from the rear wall at a third distance, and the second distance and the third distance are equal. It is also contemplated that either or both of the first and second vertical support rails 502, 503 can extend a distance equal to the first distance $d_1$ of the air tower 501, or may even extend a distance greater than that of the air tower 501 to penetrate into the refrigerated compartment. It is further contemplated that other vertical shelf supports (not shown in FIG. 6, but see general examples in FIGS. 8-9) would be attached to the rear wall at locations horizontally outwards and generally about the first and second interior liner sections 24*a*, 24*b*.

Figure 7A:
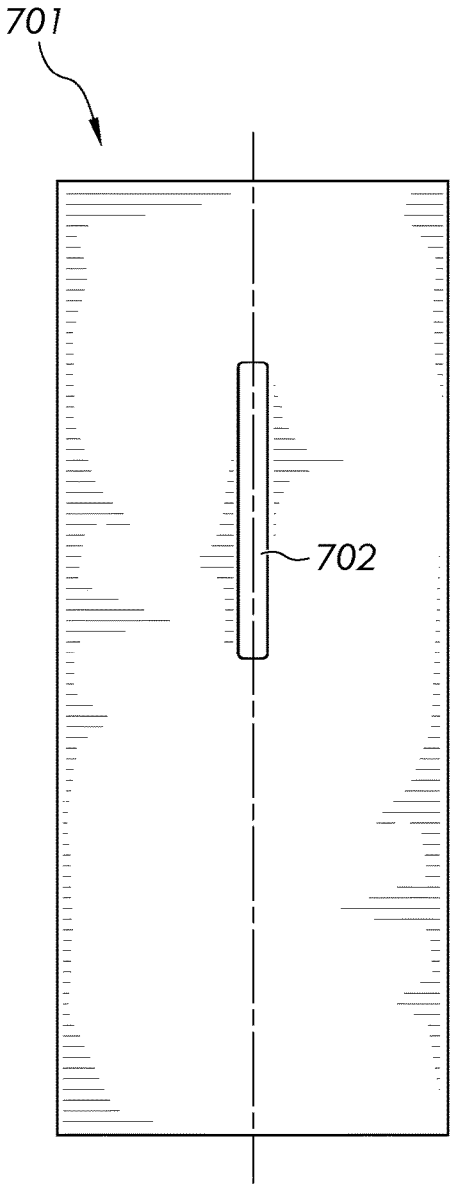
FIG. 7A is a front view of a cover for a refrigerator having symmetrical doors.
Figure 7B:
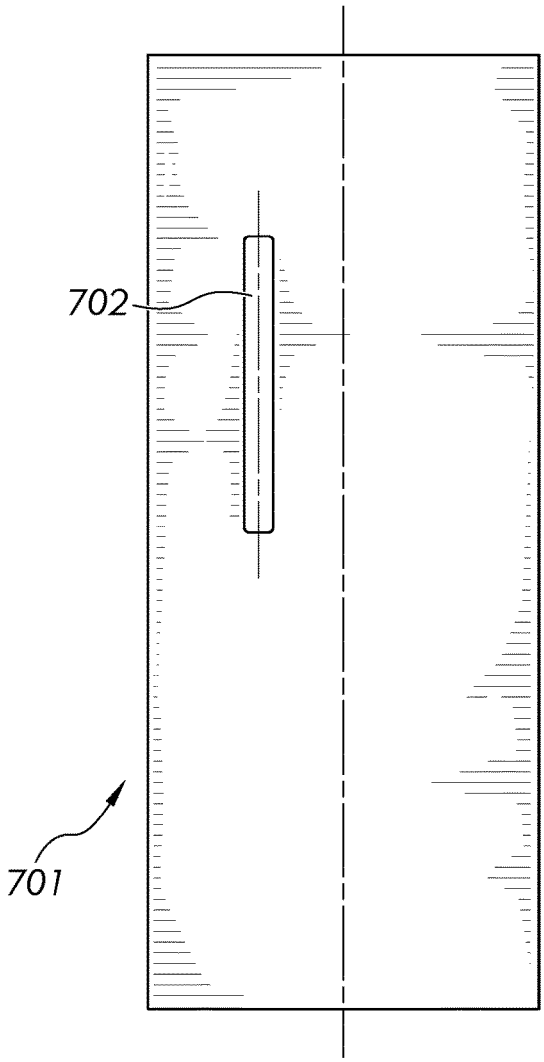
FIG. 7B is a front view of a cover for a refrigerator having asymmetrical doors.

Referring now to FIGS. 7A-7B, a cover 701 is shown that is configured to attach to the air tower 501. The cover 701 is shaped to correspond to the shape of the air tower 501. Although shown to correspond to the full lateral and vertical dimensions of the air tower 501, it is appreciated that the cover 701 may be relatively smaller than the air tower 501. Additionally, the cover 701 could be formed of various materials, such as metal (e.g., stainless steel or aluminum) or plastic. Moreover, the cover 701 includes a vertical slot 702 (i.e., an aperture) extending therethrough. The vertical slot 702 is configured to align with and allow access to a selected one of the first vertical support rail 502 (configuration of FIG. 7A) and the second vertical support rail 503 (configuration of FIG. 7B) depending on whether the two opposing refrigerator doors 16 have a symmetrical or asymmetrical configuration. Otherwise, the cover 701 generally covers and/or encloses the remainder of the aperture 504.

Figure 9:
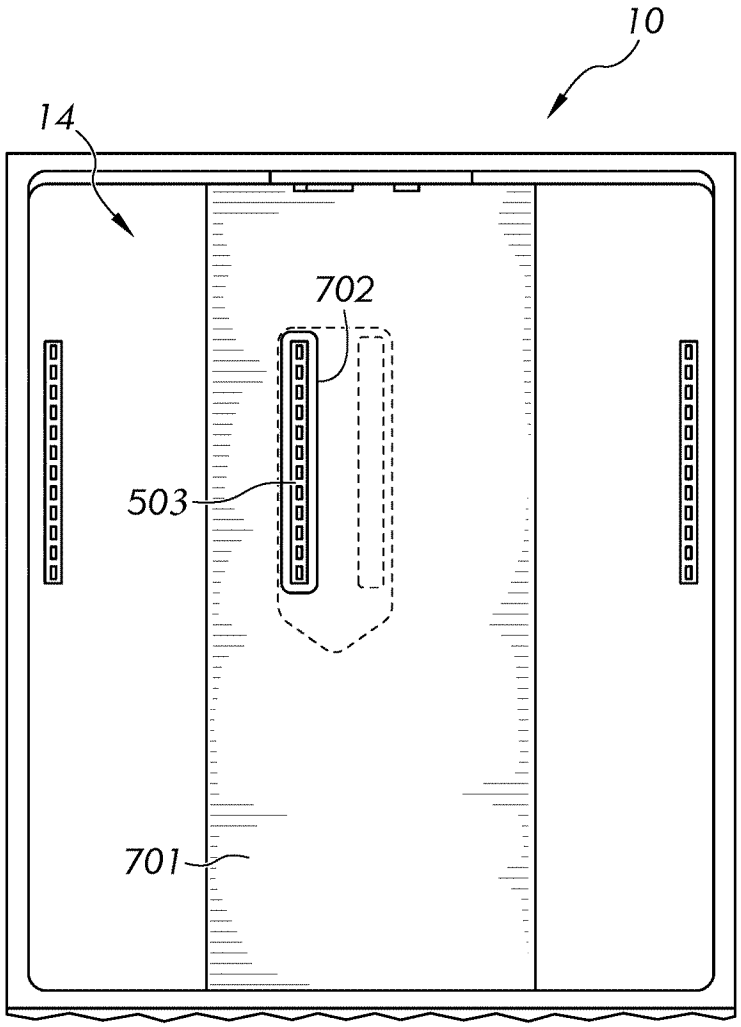
FIG. 9 is a front view of a fresh food compartment of a refrigerator predetermined to have asymmetrical doors, and the cover of FIG. 7B attached to the liner.
Figure 8:
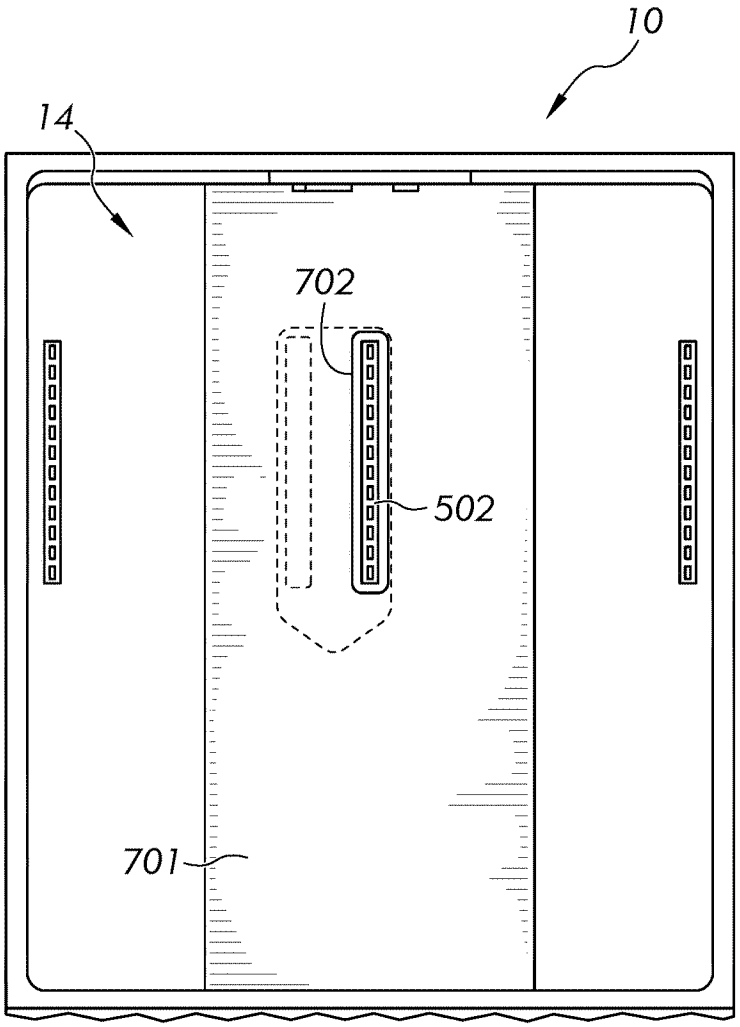
FIG. 8 is a front view of a fresh food compartment of a refrigerator predetermined to have symmetrical doors, and the cover of FIG. 7A attached to the liner.

Specifically, as shown in FIGS. 8-9, an outer profile of the cover 701 corresponds to an outer profile of the air tower 501 of the interior liner 24. The cover 701 is positioned over the aperture 504 and attached to the air tower 501. In the shown examples, the cover 701 is not shown to have any airflow exhaust openings. However, depending upon the configuration of the air tower 501, one or more exhaust openings can be provided to distribute cooled air flow to various portions of the refrigerated compartment.

The refrigerator depicted in FIG. 8 is predetermined to have refrigerator doors with a symmetrical configuration. Thus, the cover 701 (as independently shown in FIG. 7A) is configured such that the slot 702 is aligned with the first vertical support rail 502 while a portion of the cover 701 is positioned over and prevents access to the second vertical support rail 503 (illustrated in hidden lines). In other words, the slot 702 includes a lateral center line that is aligned with the lateral center line of the fresh food compartment 14 and further is shaped to allow access to the first vertical support rail 502.

Alternatively, the refrigerator depicted in FIG. 9 is predetermined to have refrigerator doors with an asymmetrical configuration. Thus, the cover 701 (as independently shown in FIG. 7B) is configured such that the slot 702 is aligned with the second vertical support rail 503 while a portion of the cover 701 is positioned over and prevents access to the first vertical support rail 502 (illustrated in hidden lines). In other words, the slot 702 includes a lateral center line that is offset a distance of L from the lateral center line of the fresh food compartment 14 and further is shaped to allow access to the second vertical support rail 503. The distance L of the slot 702 is intended to correspond with and align to the distance L of the support rail 503.

Figure 10A:
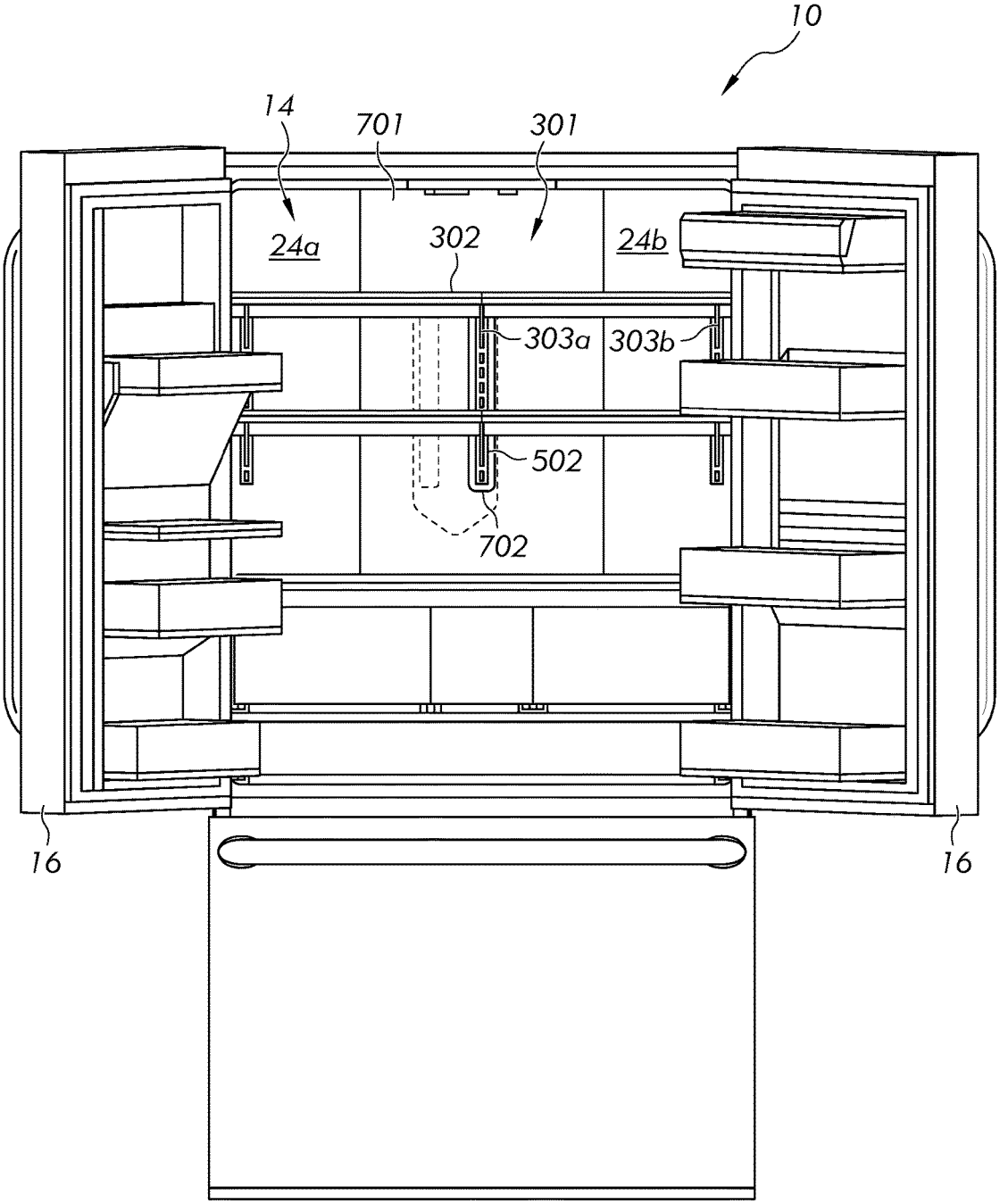
FIG. 10A is a front view of the refrigerator of FIG. 4A, wherein the cover of FIG. 7A is attached to the liner and a shelf panel is attached to vertical supports via shelf support arms.

FIG. 10A depicts the refrigerator of FIG. 4A, wherein said refrigerator 10 includes opposing doors 16 that have a symmetrical configuration. The cover 701 (as shown in FIG. 7A) is positioned over the air tower such that the vertical slot 702 is aligned with the first vertical support rail 502 while a portion of the cover 701 is positioned over and prevents access to the second vertical support rail 503. Additionally, a shelf assembly 301 is installed within the fresh food compartment 14. Specifically, first and second shelf support arms 303*a*, 303*b* are selectively mounted, at corresponding heights, to the first vertical support rail 502 and an opposing vertical support rail, respectively. A shelf panel 302 is attached to the first and second shelf support arm 303*a*, 303*b* and is thus supported at a desired height within the fresh food compartment 14.

Figure 10B:
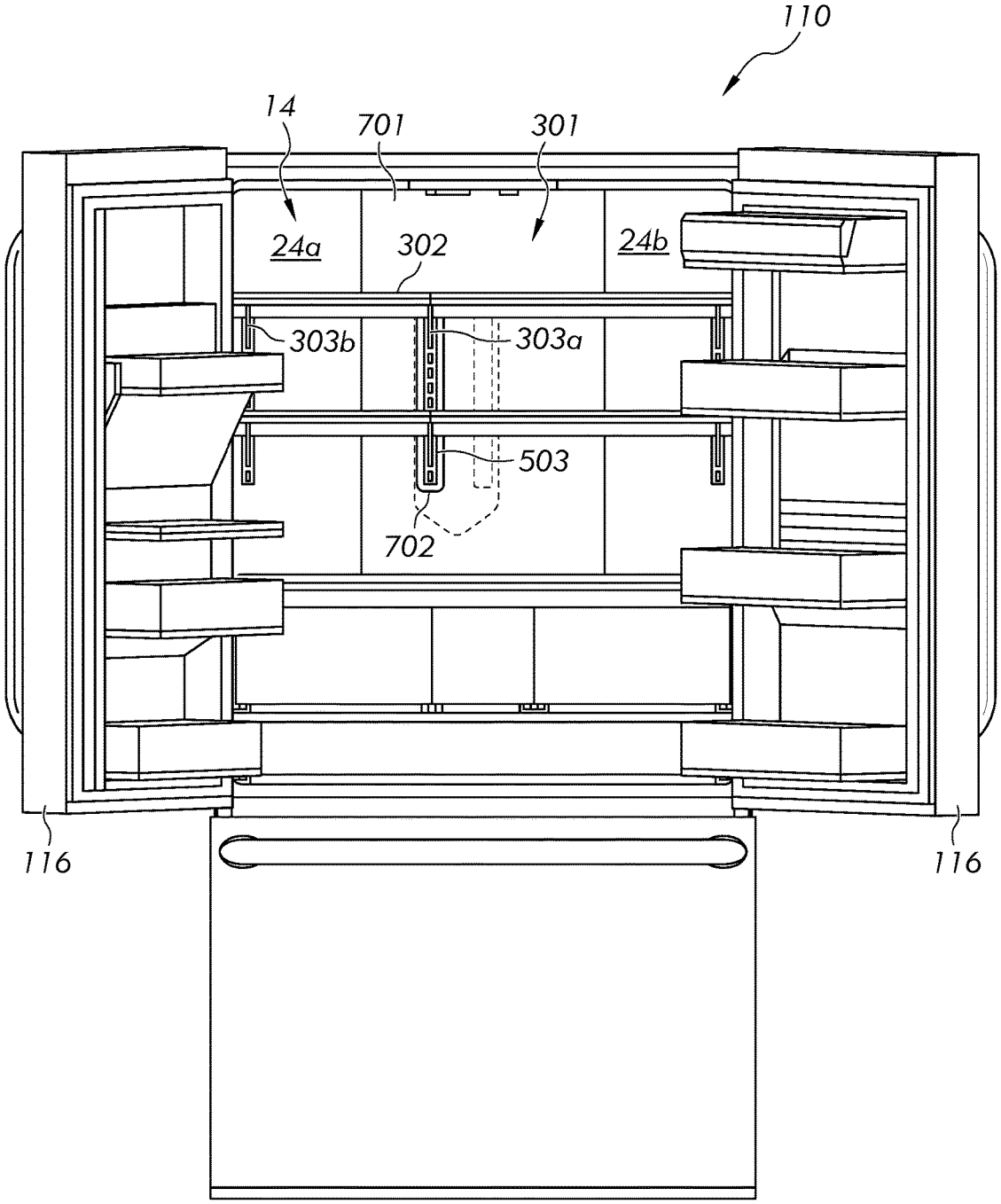
FIG. 10B is a front view of the refrigerator of FIG. 4B, wherein the cover of FIG. 7B is attached to the liner and a shelf panel is attached to vertical supports via shelf support arms.

FIG. 10B depicts the refrigerator of FIG. 4B, wherein said refrigerator 110 includes opposing doors 116 that have an asymmetrical configuration. The cover 701 (as shown in FIG. 7B) is positioned over the air tower such that the vertical slot 702 is aligned with the second vertical support rail 503 while a portion of the cover 701 is positioned over and prevents access to the first vertical support rail 502. Additionally, a shelf assembly 301 is installed within the fresh food compartment 14. Specifically, first and second shelf support arms 303*a*, 303*b* are selectively mounted, at corresponding heights, to the first vertical support rail 502 and an opposing vertical support rail, respectively. A shelf panel 302 is attached to the first and second shelf support arm 303*a*, 303*b* and is thus supported at a desired height within the fresh food compartment 14.

Thus, as can be seen by the foregoing description, the cover 701 is configured to permit access to a selected one of the first and second vertical support rails 502, 503, while inhibiting access to the other, as suitable for refrigerator doors in a symmetrical or asymmetrical configuration. Preferably, both of the first and second vertical support rails 502, 503 have the same profile, major dimensions and vertical shelf support locations so that they are interchangeable within the same slot 702.

In this manner, the refrigerator appliance architecture, manufacturing, and service are all simplified in that a single air tower and/or support rail configuration can be commonly used to define the refrigerated compartment regardless of whether the refrigerator appliance will be configured for symmetrical or asymmetrical doors. Additionally, the aforementioned refrigerator appliance architecture ensures that an end user (i.e., a consumer) is unaware of the covered (i.e., unused) vertical support rail, thus improving the overall aesthetics of the fresh food compartment.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A refrigerator appliance comprising:

a compartment within the refrigerator appliance for storing food items in a cooled environment, the compartment comprising:

a liner defining a rear wall of the compartment, a first vertical support rail attached to the rear wall, a second vertical support rail attached to the rear wall wherein the second vertical support rail is offset in a generally horizontal direction from the first vertical support rail, and a cover attachable to the liner on the rear wall of the compartment, the cover including a vertical slot extending therethrough and configured to align with and allow access to one of the first vertical support rail and the second vertical support rail when the cover is attached to the liner, while a portion of the cover is positioned over and prevents access to the other of the first vertical support rail and the second vertical support rail;

a shelf support arm that is selectively mounted to said one of the first vertical support rail and the second vertical support rail that is accessible via the vertical slot; and a shelf panel configured to attach to the shelf support arm to thereby be supported within the compartment.

2. The refrigerator appliance according to claim 1, wherein the liner includes an air tower extending outwards from the rear wall, and the cover is indirectly attached to the liner via the air tower.

3. The refrigerator appliance according to claim 2, wherein an aperture is formed into the air tower.

4. The refrigerator appliance according to claim 3, wherein the air tower extends outwards from the rear wall at a first distance, and the aperture extends completely through the air tower.

5. The refrigerator appliance according to claim 4, wherein the first vertical support rail and the second vertical support rail are positioned in the aperture formed into the air tower.

6. The refrigerator appliance according to claim 3, wherein an outer profile of the cover corresponds to an outer profile of the air tower.

7. The refrigerator appliance according to claim 3, wherein the cover is positioned over the aperture and attached to the air tower.

8. The refrigerator appliance according to claim 1, wherein one of the first vertical support rail and the second vertical support rail aligns with a plane bisecting the compartment into two equal halves in the horizontal direction.

9. The refrigerator appliance according to claim 3, wherein the aperture comprises a top portion, a bottom portion, and first and second opposing side portions, and wherein the first and second opposing side portions traverse a generally vertical direction with respect to the rear wall.

10. The refrigerator appliance according to claim 9, wherein the bottom portion of the aperture comprises a pointed tip that divides a flow of air into a first flow path and a second flow path, and wherein the first flow path and the second flow path are positioned adjacent the first and second opposing side portions, respectively.

11. The refrigerator appliance according to claim 5, wherein at least one of the first vertical support rail and the second vertical support rail extends from the rear wall at a second distance, and wherein the first distance is greater than the second distance.

12. The refrigerator appliance according to claim 5, wherein the first vertical support rail extends from the rear wall at a second distance, the second vertical support rail extends from the rear wall at a third distance, and wherein the second distance and third distance are equal.

13. A refrigerator appliance comprising:

a compartment within the refrigerator appliance for storing food items in a cooled environment, the compartment comprising:

a liner defining a rear wall of the compartment, the liner including an air tower that extends outwards from the rear wall and includes a centrally located aperture formed therethrough, a first vertical support rail attached to the rear wall, a second vertical support rail attached to the rear wall wherein the second vertical support rail is offset in a generally horizontal direction from the first vertical support rail, and a cover positioned over the aperture and attachable to the air tower, the cover including a vertical slot extending therethrough and configured to align with and allow access to one of the first vertical support rail and the second vertical support rail when the cover is attached to the air tower, while a portion of the cover is positioned over and prevents access to the other of the first vertical support rail and the second vertical support rail;

a shelf support arm that is selectively mounted to said one of the first vertical support rail and the second vertical support rail that is accessible via the vertical slot; and a shelf panel configured to attach to the shelf support arm to thereby be supported within the compartment.

14. The refrigerator appliance according to claim 13, wherein the air tower extends outwards from the rear wall at a first distance, and the aperture extends completely through the air tower.

15. The refrigerator appliance according to claim 14, wherein the first vertical support rail and the second vertical support rail are positioned in the aperture formed into the air tower.

16. The refrigerator appliance according to claim 14, wherein at least one of the first vertical support rail and the second vertical support rail extends from the rear wall at a second distance, and wherein the first distance is greater than the second distance.

17. The refrigerator appliance according to claim 13, wherein one of the first vertical support rail and the second vertical support rail aligns with a plane bisecting the compartment into two equal halves in the horizontal direction.

* * * * *